US006589374B2

(12) United States Patent
Wanninger

(10) Patent No.: US 6,589,374 B2
(45) Date of Patent: Jul. 8, 2003

(54) POURABLE, PLASTIC-BOUND EXPLOSIVE CHARGES AND METHOD OF MAKING THE SAME

(75) Inventor: Paul Wanninger, Hermannsburg (DE)

(73) Assignee: Rheinmetall W & M GmbH, Unterlüss (DE)

( * ) Notice: Subject to any disclaimer, the term of this patent is extended or adjusted under 35 U.S.C. 154(b) by 33 days.

(21) Appl. No.: 09/991,926

(22) Filed: Nov. 26, 2001

(65) Prior Publication Data

US 2002/0096233 A1 Jul. 25, 2002

(30) Foreign Application Priority Data

Nov. 25, 2000 (DE) ..... 100 58 705

(51) Int. Cl.[7] ..... C06B 45/10; C06B 33/00; C06B 25/00

(52) U.S. Cl. ..... 149/19.92; 149/19.1; 149/19.4; 149/37; 149/88; 149/109.6

(58) Field of Search ..... 149/19.1, 19.4, 149/19.92, 37, 88, 109.6

(56) References Cited

U.S. PATENT DOCUMENTS

| | | | | |
|---|---|---|---|---|
| 2,969,638 A | * | 1/1961 | Sammons | 60/35.4 |
| 3,255,281 A | | 6/1966 | Alexander | |
| 3,865,035 A | | 2/1975 | Munson et al. | |
| 4,363,679 A | | 12/1982 | Hagel et al. | |
| 4,405,534 A | * | 9/1983 | Deisenroth | 264/3 |
| 4,747,892 A | | 5/1988 | Spencer | |
| 5,404,813 A | | 4/1995 | Wong | |
| 5,472,531 A | | 12/1995 | Turci et al. | |
| 5,942,720 A | * | 8/1999 | Doll et al. | 149/19.92 |

FOREIGN PATENT DOCUMENTS

| | | |
|---|---|---|
| DE | 3804396 C1 | 5/1989 |
| DE | 4324739 C1 | 8/1994 |
| DE | 19616627 A1 | 11/1997 |

OTHER PUBLICATIONS

J. Köhler, et al., "Explosive Substances", 7$^{th}$ Edition, Weinheim, Basel, Cambridge, New York, VCH 1991, pp. 9 and 185.

* cited by examiner

*Primary Examiner*—Michael J. Carone
*Assistant Examiner*—Aileen B. Felton
(74) *Attorney, Agent, or Firm*—Venable LLP; Norman N. Kunitz

(57) ABSTRACT

A pourable, plastic-bound explosive charge has a crystalline explosive substance embedded in a polymer matrix which includes a binder, a softener and a metal powder. The metal powder which is added in a proportion of 0.1 to 10 weight % has substantially spherical grains and is one or more of the following materials: vanadium, niobium, tantalum, chromium, molybdenum or tungsten.

6 Claims, No Drawings

POURABLE, PLASTIC-BOUND EXPLOSIVE CHARGES AND METHOD OF MAKING THE SAME

CROSS REFERENCE TO RELATED APPLICATION

This application claims the priority of German Application No. 100 58 705.4 filed Nov. 25, 2000, which is incorporated herein by reference.

BACKGROUND OF THE INVENTION

This invention relates to pourable, plastic-bound explosive charges and a method of making the same, wherein a crystalline explosive material is embedded in a polymer matrix composed of a binder, a softener and further auxiliary substances.

Plastic-bound explosive charges have, despite their high efficiency, a relatively elevated insensitivity. They are composed of reaction polymers in which, prior to setting, crystalline explosive substances such as octogen, hexogen, pentaerythrite tetranitrate and the like are included. The polymer proportion is approximately 10–20 weight %.

It is a difficulty involving the manufacture of plastic-bound explosive charges that with the increase of the proportion of the explosive material, the viscosity of the mixture may increase to such an extent that pouring such a mixture is not possible. The theoretical limit for a pourable mixture lies at 92 weight %. It has been nevertheless found that the practical limit for a pourable mixture is at approximately 90 weight %. Further, explosive charges having a solid material proportion of such an extent are pourable only when the grain size of the explosive substance crystals used for the charge is within a predetermined diametral range; thus, as a result, a relatively cost-intensive sifting of the grains by screening has been necessary.

As discussed on pages 9 and 185 in the work entitled "Explosive Substances" authored by J. Köhler and R. Meyer ($7^{th}$ Edition, Weinheim, Basel, Cambridge, N.Y., VCH 1991), it is known to add aluminum powder to plastic-bound explosive charges. Such an addition results in a significant increase of calories by virtue of the intense heat generated by aluminum oxide. The cited work, however, is mute concerning an improvement of the viscosity of the explosive charge.

SUMMARY AND DESCRIPTION OF THE INVENTION

It is an object of the invention to provide an improved method of making insensitive, pourable, plastic-bound explosive charges which have a high (for example, 90 weight %) solid substance proportion and which further have a substantially low viscosity for making the explosive material pourable without the need of sifting the grains.

This object and others to become apparent as the specification progresses, are accomplished by the invention, according to which a crystalline explosive substance is embedded in a polymer matrix including a binder, a softener and a metal powder. The metal powder which is added in a proportion of 0.1 to 10 weight %, has substantially spherical grains and is one or more of the following materials: vanadium, niobium, tantalum, chromium, molybdenum or tungsten.

When using such a metal powder which, by virtue of the spherical form of the powder grains has a very small specific outer surface, it has been surprisingly found that the spherical powder grains behave similarly to liquid lubricants between the coarse-grained explosive substance particles (tribological effect). As a result, a relatively low viscosity between 400 and 1200 Pas is obtained at 50° C.

By virtue of the invention, explosive charges may be manufactured without difficulty since, despite a 90 weight % of solid substance proportion, the explosive charges have a viscosity which equals that of conventional explosive charges having a solid substance proportion of 85 weight %.

Spherical aluminum powder for decreasing the viscosity has, by itself, not been successful in practice because such powders are, on the one hand, difficult to obtain and, on the other hand, ignite easily and therefore may readily lead to dust explosions during manufacture.

Similarly to explosive charges to which aluminum powder is added, the explosive charges according to invention also have an increased blast effect by virtue of the exothermal reaction of the metal powder with the oxygen present in air. Such an effect contributes to the destruction of structures and constructions by excess pressure. The obtained metal oxides sublimate, that is, they change directly from the solid phase into the gaseous phase.

The weight % range of the metal powder used according to the invention depends from the specific surface of the metal powder and the grain size; it is empirically preferably between 2–5 weight %, while the grain size is preferably between 0.1 and 5 $\mu$m.

Octogen (HMX), hexogen (RDX) and pentaerythrite tetranitrate (PETRIN) have been found as advanteous explosive substances.

The manufacture of the explosive charges according to the invention may be carried out based on the following typical recipe:

| | |
|---|---|
| 80–88 weight % | crystalline explosive material such as RDX or HMX |
| 5–10 weight % | binder, for example, HTPB |
| 5–10 weight % | softener |
| 0.01–0.2 weight % | coupling agent |
| 0.05–0.5 weight % | pouring aids |
| 0.1–1.0 weight % | antioxidants and |
| 0.1–10 weight % | metal powder according to the invention, having spherical grains and selected from vanadium, niobium, tantalum, chromium, molybdenum or tungsten. |

It will be understood that the above description of the present invention is susceptible to various modifications, changes and adaptations, and the same are intended to be comprehended within the meaning and range of equivalents of the appended claims.

What is claimed is:

1. A method of making a pourable, plastic-bound explosive charge; comprising the step of embedding a crystalline explosive substance in a polymer matrix including a binder, a softener and a metal powder in a proportion of 0.1 to 10 weight %; said metal powder having substantially spherical grains and being selected from at least one of the materials of the group consisting of vanadium, niobium, tantalum, chromium, molybdenum and tungsten.

2. The method as defined in claim 1, wherein said proportion is 2 to 5 weight %.

3. The method as defined in claim 1, wherein the grain size of said metal powder is between 0.1 and 5 micron.

4. A pourable, plastic-bound explosive charge comprising a crystalline explosive substance and a polymer matrix embedding said crystalline explosive substance; said polymer matrix including a binder, a softener and a metal powder in a proportion of 0.1 to 10 weight %; said metal powder having substantially spherical grains and being selected from at least one of the materials of the group consisting of vanadium, niobium, tantalum, chromium, molybdenum and tungsten.

5. The explosive charge as defined in claim 4, wherein said proportion is 2 to 5 weight %.

6. The explosive charge as defined in claim 4, wherein the grain size of said metal powder is between 0.1 and 5 micron.

* * * * *